United States Patent [19]

Kiyohara

[11] Patent Number: 5,023,629

[45] Date of Patent: Jun. 11, 1991

[54] INK JET RECORDING APPARATUS WITH A MEMBER FOR ABSORBING WASTE INK CREATED BY INSERTION AND REMOVAL OF AN INK CONTAINER

[75] Inventor: Takehiko Kiyohara, Zama, Japan

[73] Assignee: Canon Kabushiki Kaisha, Tokyo, Japan

[21] Appl. No.: 405,212

[22] Filed: Sep. 11, 1989

Related U.S. Application Data

[63] Continuation of Ser. No. 237,641, Aug. 26, 1988, Pat. No. 4,878,069, which is a continuation of Ser. No. 82,946, Aug. 10, 1987, abandoned, which is a continuation of Ser. No. 752,538, Jul. 8, 1985, abandoned.

[30] Foreign Application Priority Data

Jul. 9, 1984 [JP] Japan ..... 59-140744

[51] Int. Cl.[5] ..... B41J 2/175

[52] U.S. Cl. ..... 346/140 R

[58] Field of Search ..... 346/140

[56] References Cited

U.S. PATENT DOCUMENTS

| | | | |
|---|---|---|---|
| 4,015,272 | 3/1977 | Yamamori et al. | 346/140 R |
| 4,119,034 | 10/1978 | Wax | 101/366 |
| 4,156,244 | 5/1979 | Erikson et al. | 346/140 R |
| 4,253,103 | 2/1981 | Heinzl | 346/140 R |
| 4,277,791 | 7/1981 | Rosenstock et al. | 346/140 R |
| 4,306,245 | 12/1981 | Kasugayama et al. | 346/140 R |
| 4,320,406 | 3/1982 | Heinzl | 346/140 R |
| 4,367,482 | 1/1983 | Heinzl | 346/140 R |
| 4,419,678 | 12/1983 | Kasugayama et al. | 346/140 R |
| 4,432,005 | 2/1984 | Duffield et al. | 346/140 R |
| 4,484,202 | 11/1984 | Sayko | 346/140 R |
| 4,511,906 | 4/1985 | Hara | 346/140 R |
| 4,575,736 | 3/1986 | Roschlein et al. | 346/140 R |
| 4,586,058 | 4/1986 | Yamazaki et al. | 346/140 R |

FOREIGN PATENT DOCUMENTS

| | | |
|---|---|---|
| 215870 | 12/1984 | Japan . |
| 192645 | 10/1985 | Japan . |

*Primary Examiner*—Joseph W. Hartary

*Attorney, Agent, or Firm*—Fitzpatrick, Cella, Harper and Scinto

[57] ABSTRACT

An ink jet recording apparatus has a recording head and replaceable ink container. The ink container is removably mounted on the apparatus and a hollow needle, connected by an ink supply path to a recording head, punctures the ink container as it is put in place on the apparatus. An absorbing material is located on the apparatus near the needle to absorb any waste ink than may fall from the needle or the ink container as the ink container is put in place or removed from the apparatus.

3 Claims, 1 Drawing Sheet

INK JET RECORDING APPARATUS WITH A MEMBER FOR ABSORBING WASTE INK CREATED BY INSERTION AND REMOVAL OF AN INK CONTAINER

This application is a continuation of application Ser. No. 07/237,641 filed Aug. 26, 1988, now U.S. Pat. No. 4,878,069, which is a continuation of application Ser. No. 07/082,946, filed Aug. 10, 1987, now abandoned, which is a continuation of application Ser. No. 06/752,538, filed July 8, 1985, now abandoned.

BACKGROUND OF THE INVENTION

1. Field of the Invention

The present invention relates to an ink jet recording apparatus and more particularly to an improvement of an ink jet recording apparatus of the type in which one or more of a plurality of ink containers are replaceably fitted into a carriage.

2. Description of the Prior Art

As is well known, ink jet recording apparatuses have characterizing features wherein printing is effected with the generation of a noise level which is kept lower than that of wire dot type or heat sensitive type recording apparatus. An ink jet apparatus may be suitably employed for printing at a high speed. Moreover, color printing is easy to be achieved. For the above reasons, it is preferably used for an output device of electronic apparatus in the form of a printer, facsimile apparatus or the like.

The ink jet recording apparatus is generally constructed such that ink held in the ink containers is introduced into the recording head and it is then injected from ink discharging orifices toward a recording medium (e.g. paper) by activating an ink discharging energy generator disposed on the recording head in response to a printing pattern signal (recording signal). The ink discharging energy generator is adapted to generate energy required for discharging liquid (ink) from the ink discharging orifices. Thus, dot printing is effected by repeatedly injecting ink toward the recording medium.

To avoid connection of ink containers to the recording head by using long feeding tubes a recording apparatus of the above-mentioned type is often so constructed that ink containers are replaceably mounted on a carriage adapted to move along the recording medium together with a recording head disposed on the carriage. As a result, the recording apparatus can be designed in smaller dimensions.

In a conventional ink jet recording apparatus, a substantially rectangular cartridge type ink container is mounted on the carriage by inserting it from above or from the back side relative to the carriage.

On the other hand, the carriage is provided with electric circuits for turning on the recording head to activate the energy generator and a guide section for displaceably supporting the carriage. To allow the electric circuits and the guide section to be accomodated in a limited space on the carriage a variety of proposals have been already made from the design viewpoint.

However, since the conventional recording apparatus is so constructed that each of the ink containers is replaceably mounted horizontally in the above-described manner, it is difficult to keep the space required for accomodating therein electric circuits and making electric connection therebetween when the recording apparatus is designed in smaller dimensions. Another problem of the conventional recording apparatus is that there is a necessity for forming projections in order to build the guide section which serves to displaceably support the carriage, resulting in the design of the recording apparatus in a compact structure being achieved only with much difficulty.

Yet, another problem with the conventional recording apparatus is that ink held in each of the ink containers cannot be fully consumed in spite of the fact that an ink intake port is located at the position in the proximity of the bottom of the ink container, because the bottom of the ink container is flat and moreover it is held horizontally.

SUMMARY OF THE INVENTION

Hence, the present invention has been made with the foregoing problems in mind.

It is an object of the present invention to provide an improved ink jet recording apparatus of the previously mentioned type which assures that a space in the carriage is utilized in the optimum manner by forming two hollow spaces at both the upper and lower parts of the carriage to accomodate electric circuits in the one hollow space and to build a guide section in the other hollow space.

It is another object of the present invention to provide an improved ink jet recording apparatus of the previously mentioned type which assures that ink stored in each of the ink containers is fully used.

It is another object of the present invention to provide an improved ink jet recording apparatus which is constructed within compact structure and in which each of the ink containers can be easily fitted into the carriage.

It is a further object of the present invention to provide an improved ink jet recording apparatus of the previously mentioned type which assures that each of the ink containers is replaceably fitted into the carriage in such an inclined state that the rear side is raised above the fore side thereof.

To accomplish the above objects there is proposed, according to the present invention, an ink jet recording apparatus of the type in which a recording head is carried on a carriage adapted to move along a recording medium and ink stored in a plurality of ink containers is introduced into the recording head so that ink is injected through a plurality of ink discharging orifices toward the recording medium by activating an energy generator disposed on the recording head in response to a recording signal, the energy generator serving to generate energy which is utilized for the purpose of discharging ink, wherein the improvement consists in that the ink containers are replaceably fitted into the carriage in such an inclined state that the rear side is raised above the fore side thereof.

When the ink containers are fitted into the carriage, two hollow spaces are formed at both the upper and lower parts of the carriage. One of them is utilized to accommodate electric circuits and the other one is utilized to house a guide section for displaceably supporting the carriage. Thus, the space of the carriage can be utilized in the optimum manner.

Since each of the ink containers is fitted in the inclined posture, ink stored therein can be fully consumed.

By virtue of arrangement of the recording apparatus made in that way it can be designed and constructed in smaller dimensions with useles space being reduced substantially.

Other objects, features and advantages of the present invention will become more clearly apparent from reading of the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENT

Now, the present invention will be described in greater detail hereunder with reference to the accompanying drawings which illustrate a preferred embodiment thereof.

Figure 1:
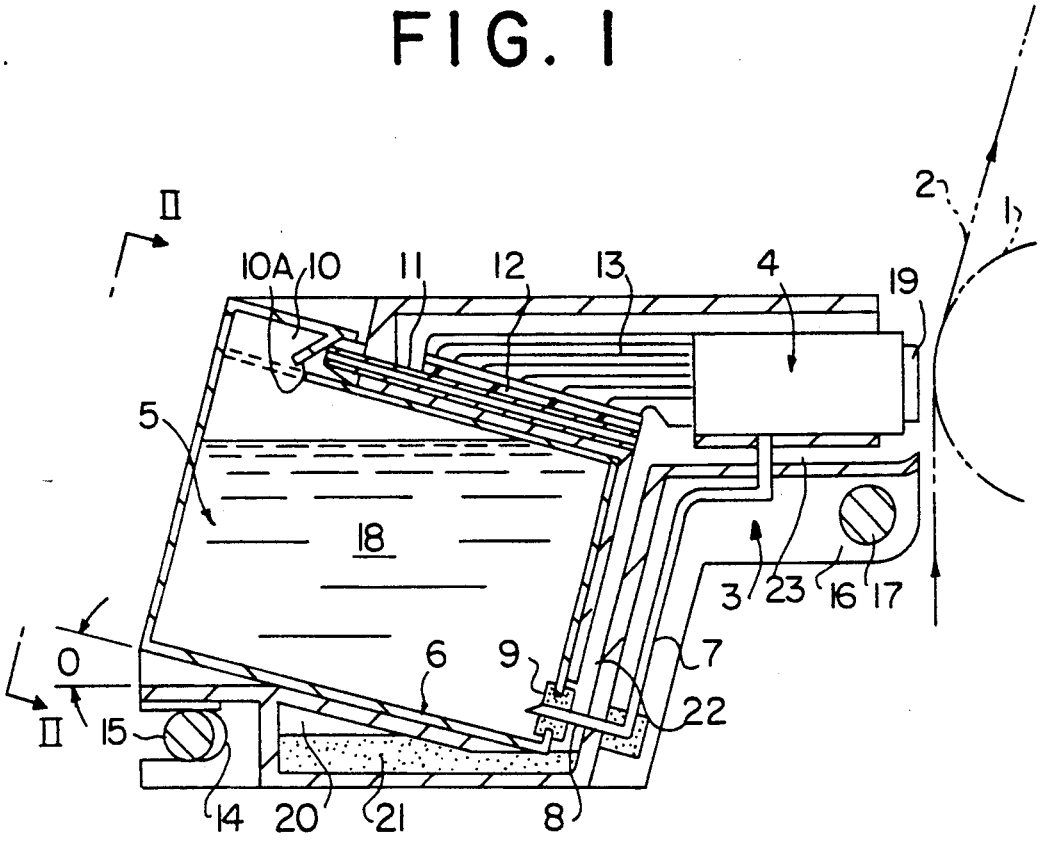
FIG. 1 is a vertical sectional view of an ink jet recording apparatus in accordance with an embodiment of the invention.
Figure 2:
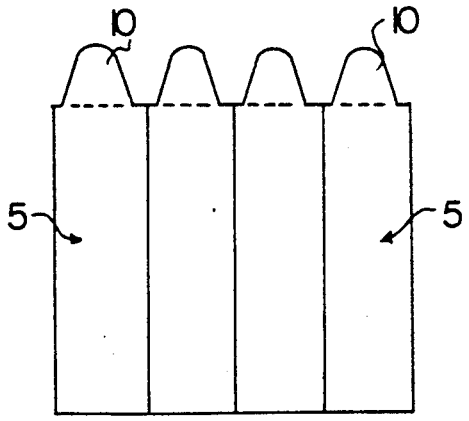
FIG. 2 is a front view of the apparatus as seen from line II—II in FIG. 1.

FIG. 1 is a vertical sectional view of a carriage on which a plurality of ink containers are mounted. A recording head 4 and a plurality of ink containers 5 are mounted on the carriage 3 adapted to move along a recording material (paper) 2 which is brought in contact with a platen 1. In the illustrated embodiment, as can be seen in FIG. 2, the apparatus is shown to include the number (four) of recording heads 4 to effect color printing and the same number (four) of ink containers 5 as that of the recording heads 4.

As is apparent from the drawing, each of the ink containers 5 in each of container fitting or supporting sections 6 is supported fitting sections 6 in such an inclined state that it is turned by a certain angle in the clockwise direction as seen in the drawing. The container fitting section 6 is designed in the cavity-shaped configuration of which the left-hand side is raised up above the right-hand side as seen in the drawing.

The container fitting section 6 has a hollow needle 8 fixedly secured thereto through an opening in the fitting section 6, by way of which needle the container is in communication with the recording head 4. As will be readily understood from the drawing, an ink intake hole 9 is formed by piercing the hollow needle 8 through an intake portion on the container 5 in connection with of fitting operation of the container.

In the illustrated embodiment the container 5 has a folding portion at the position located in the fore part of an upper projection 10 and an air vent hole 10A is formed by breaking the folding portion under the effect of a thrusting force provided by a thrusting portion on the foremost end of a communication tube 11 which is fitted through the wall of the carriage 3. It should be noted that breaking of the folding portion is achieved in connection with the of fitting operation of the container. The air vent hole 10 communicates with the outside atmosphere via the communication tube 11.

Since the ink container 5 is fitted in such an inclined posture that it is turned by a predetermined angle of $\theta$ in the clockwise direction as seen in the drawing, hollow spaces having the substantially triangular sectional configuration are formed at the upper fore part of the carriage as well as at the lower rear part of the same. In the illustrated embodiment the hollow space located at the upper fore part of the carriage 3 serves to accomodate therein a circuit base board 12 with an electric circuit for turning on the recording head 4 arranged thereon and other electronic components such as flexible circuits 13 or the like. On the other hand, the hollow space located at the lower rear part of the carriage 3 serves to build a guide portion 14 for displaceably supporting the carriage 3.

Thus, the carriage 3 is ready to move in the leftward or rightward direction (in the vertical direction as seen relative to the plane of the drawing) with the aid of a guide shaft 15 extending through the guide portion 14 and another guide shaft 17 extending through the fore guide portion 16. Ink 18 held in the ink container 5 is introduced into the recording head 4 via the hollow needle 8 and the ink feeding tube 7. In response to printing pattern signals transmitted from the electric circuits 12 and 13 a plurality of discharging orifices on the recording head 4 (identified by a plurality of recording head chips 19 in the drawing which constitute the discharging orifices each of which is in operative association with an energy generator) become activated whereby ink is injected toward the recording material 2 to effect ink dot printing.

As is apparent from FIG. 1, the apparatus is provided with a waste ink reservoir 20 in the bottom area of the carriage 3 and an ink absorbing material 21 is placed in the waste ink reservoir 20. The latter is communicated with the air vent hole 10A via the communication tube 11 and the passage 22 which in turn is communicated with the lower part of the recording head chips 19 via a passage 23 disposed below the recording head 4. Thus, ink leaked from the air vent hole 10A and waste ink leaking from the discharging orifices or dripping from the recording head chips 19 is introduced into the waste ink reservoir 20 and it is then absorbed in the ink absorbing material 21.

As described above, the apparatus of the invention is so constructed that a plurality of ink containers 5 are fitted into the carriage 3 in the inclined posture and hollow spaces having the substantially triangular sectional configuration are formed at both the upper and lower parts of the carriage 3 so that electric circuits 12 and 13 for turning on the recording head 4 are accomodated in the upper hollow space and a guide portion 14 is accommodated for the purpose of supporting the carriage 3, in the lower hollow space. As a result, the apparatus has an advantageous feature that a limited space in the carriage 3 can be utilized in the optimum manner.

Further, since the ink intake hole 9 is located at the position in the proximity of the lowermost part of the bottom of the ink containers 5 which are fitted into the carriage 3 in the inclined posture, ink stored in the containers can be fully taken out therefrom without any loss.

In the illustrated embodiment four ink containers are mounted on the carriage but the present invention should not be limited only to this. Alternatively, the present invention may be applied to the case where a single container is mounted for a monochromatic printer or the case where more than four ink containers are mounted on the carriage in the above-described manner.

It should , of course, be understood that the present invention should not be limited only to the foregoing embodiments but various changes or modifications may be made in any acceptable manner without departing from the spirit and scope of the invention as defined by the appended claims.

Incidentally, no description has been made above with respect to the energy generator but any well known means, for instance, a converter adapted to convert electric energy into thermal energy (heating element or the like) in the case where thermal energy is utilized and a converter adapted to convert electric energy to mechanical energy (piezo-electric element, magnetostriction element or the like) in the case where mechanical energy is utilized may be employed for the appartus, provided that liquid (ink) can be injected from ink discharging orifices in response to recorded information with the aid of the energy generator.

What is claimed is:

1. An ink jet recording apparatus comprising:

an ink jet recording head;

a supporting section for removably supporting an ink container on the apparatus, the ink container being adapted to hold ink for supply to said recording head, wherein said supporting section includes a hollow needle and an opening for allowing insertion of said hollow needle into the ink container when the ink container is supported on said supporting section;

an ink supply path between said hollow needle and said recording head for supplying ink in the ink container to said recording head; and an absorbing material proximate to said opening and disposed in a reservoir formed in said supporting section for absorbing waste ink collecting near said opening during mounting or removal of the ink container.

2. An ink jet recording apparatus comprising:

an ink jet recording head;

a supporting section for removably supporting an ink container on said apparatus;

a hollow needle disposed for insertion into the ink container, the ink container being adapted to hold ink for supply to said recording head;

an ink supply path between said hollow needle and said recording head for supplying ink in the ink chamber to said recording head; and an absorbing material proximate to said needle and disposed in a reservoir formed in said supporting section for absorbing waste ink from said hollow needle or the container when the container is mounted to or removed from the apparatus.

3. An ink jet recording apparatus comprising:

an ink jet recording head;

a supporting section for detachably supporting an ink container on said apparatus;

a hollow needle disposed for insertion into the ink container, the ink container being adapted to hold ink for supply to said recording head;

an ink supply path between said hollow needle and said recording head for supplying ink in the ink chamber to said recording head; and an absorbing material proximate to said needle and disposed in a reservoir formed in said supporting section for absorbing waste ink from said hollow needle or the container when the container is mounted to or removed from the apparatus.

* * * * *

UNITED STATES PATENT AND TRADEMARK OFFICE

CERTIFICATE OF CORRECTION

PATENT NO. :5,023,629

DATED :June 11, 1991

INVENTOR(S) :Takehiko KIYOHARA

It is certified that error appears in the above-identified patent and that said Letters Patent is hereby corrected as shown below:

COLUMN 1:

Line 60, "accomodated" should read --accommodated--; and

Line 67, "accomodating" should read --accommodating--.

COLUMN 2:

Line 8, "yet," should read --yet--; and

Line 24, "accomodate" should read --accommodate--.

COLUMN 3:

Line 1, "useles" should read --useless--;

Line 35, "fitting sections 6" should be deleted;

Line 39, "up" should be deleted;

Line 47, "of" should read --the--;

Line 57, "of" (first occurrence) should be deleted; and

Line 67, "accomodate" should read --accommodate--.

COLUMN 4:

Line 43, "comodated" should read --commodated--.

UNITED STATES PATENT AND TRADEMARK OFFICE

CERTIFICATE OF CORRECTION

PATENT NO. : 5,023,629

DATED : June 11, 1991

INVENTOR(S) : Takehiko Kiyohara

It is certified that error appears in the above-identified patent and that said Letters Patent is hereby corrected as shown below:

Column 5, line 10, "appartus," should bead --apparatus,--.

Signed and Sealed this

Tenth Day of November, 1992

*Attest:*

DOUGLAS B. COMER

*Attesting Officer*

*Acting Commissioner of Patents and Trademarks*